US005518521A

United States Patent [19]

Kuo

[11] Patent Number: 5,518,521

[45] Date of Patent: May 21, 1996

[54] PROCESS OF PRODUCING A LOW TCR SURGE RESISTOR USING A NICKEL CHROMIUM ALLOY

[75] Inventor: Charles C. Y. Kuo, Elkhart, Ind.

[73] Assignee: CTS Corporation, Elkhart, Ind.

[21] Appl. No.: 148,798

[22] Filed: Nov. 8, 1993

[51] Int. Cl.[6] ..... B22F 1/00

[52] U.S. Cl. ..... 75/252; 75/255; 420/411

[58] Field of Search ..... 75/252, 255, 230, 75/246; 420/441, 442, 445

[56] References Cited

U.S. PATENT DOCUMENTS

| | | | |
|---|---|---|---|
| 3,794,518 | 2/1974 | Howell | 420/441 |
| 3,824,521 | 7/1974 | Horii et al. | 338/275 |
| 3,898,081 | 8/1975 | Kukhar | 75/171 |
| 4,060,663 | 11/1977 | Merz et al. | 428/428 |
| 4,089,676 | 5/1978 | Grundy | 420/441 |
| 4,168,344 | 9/1979 | Shapiro et al. | 428/427 |
| 4,298,505 | 11/1981 | Dorfeld et al. | 252/513 |
| 4,323,629 | 4/1982 | Kunieda et al. | 420/441 |
| 4,999,049 | 3/1991 | Balderson et al. | 75/234 |
| 5,037,670 | 8/1991 | Kuo et al. | 427/102 |

*Primary Examiner*—Scott Kastler
*Attorney, Agent, or Firm*—Albert W. Watkins

[57] ABSTRACT

Base metal resistors based on a new approach to alloy formation of nickel and chromium metals are presented that are rugged and offer excellent stability. Fine particle size nickel and chromium powders together with fluxing agents are blended together in a preselected ratio with a glass frit and screening agent. The composition is subsequently printed and fired in a nitrogen furnace at approximately 900° C. to 930° C. These resistors are compatible with other prior art base metal conductors, resistors and dielectrics.

1 Claim, No Drawings

PROCESS OF PRODUCING A LOW TCR SURGE RESISTOR USING A NICKEL CHROMIUM ALLOY

BACKGROUND OF THE INVENTION

1. Field of the Invention

This invention pertains to electrically conductive vitreous enamel compositions and methods in general, and particularly to low Temperature Coefficient of Resistance (TCR) nickel chromium compositions and methods of manufacture thereof.

2. Description of the Related Art

In recent years, a need has developed for low sheet resistance and low TCR thick film resistors for use in high power and lightning surge protection applications. These special resistors should have a sheet resistance from ¼ to a few ohms per square with a TCR less that ±100 ppm/°C. The characteristics and performance of these resistors should be comparable to those of the best ruthenium-based resistors.

TCR stands for Temperature Coefficient of Resistance, which is a measure of the amount of change in resistance over some temperature range. For the purposes of the remainder of this disclosure, TCR may be further divided into cold TCR (CTCR) and hot TCR (HTCR). Cold TCR is measured over the temperature range from −55 to +25 degrees Centigrade, while hot TCR is measured from +25 to +125 degrees Centigrade.

Resistivity for the purposes of this disclosure is measured in the units of ohms per square. This will be considered herein to be the resistance of a 1 mil thick film of equal length and width.

Resistors made from palladium-silver compositions have been used for low sheet resistance and low TCR applications. However, the cost of precious metals, especially with a high percentage of palladium, is much higher than the cost of base metals. In addition, the palladium-silver circuits may be plagued by silver migration problems.

Nichrome has been produced in wire form for heating elements for more than a century. The nickel chromium alloy is very stable, as demonstrated by the long durations of operation at very elevated temperature. In fact, nickel chromium alloys are the lowest cost and most commonly used heating alloys for temperatures up to approximately 1,000° C. Wirewound resistors have been similarly formed from Nichrome, to attempt to take advantage of these beneficial characteristics. However, these wire resistors exhibit inductance problems and are of large size, thereby limiting application.

Nichrome films formed by vacuum deposition have been used in thin film circuits for many years. The thick film approach is easier and more cost effective than thin film, thus limiting the use of thin film to special applications.

Thick film ink, using pre-alloyed nichrome powder, can meet many of the specifications required for surge and power applications for relatively low cost. However, an ink manufacturer is limited to the selection of commercially available alloys. To form alloys and then to mill the alloys into sub-micron sizes adds to the cost of materials and prolongs delivery time. Impurities during the milling process may also introduce manufacturing problems and affect quality and performance of the resulting resistor.

SUMMARY OF THE INVENTION

A thick film composition comprising elemental nickel and chromium in major fraction further contains elemental metal fluxing agents such as manganese and silicon. The fluxing agents serve to simultaneously form a low TCR resistor and greatly improve adhesion to a substrate such as alumina. The composition, which also includes conventional glass frit and screening agent, is fired at temperatures generally below 1,000° C., yielding a highly stable and well adhered electrical resistor.

DESCRIPTION OF THE PREFERRED EMBODIMENT

Fine particle size nickel and chromium powders are blended together in a preselected ratio with a glass frit and screening agent to become a thick film composition. The composition is subsequently printed and fired in a nitrogen furnace at temperatures between 900° C. and 930° C. From x-ray diffraction the resulting fired thick film has been identified as a solid solution of nickel and chromium.

In practice of the preferred embodiment of the invention, fine nickel and chromium powder and a small amount of flux agents such as manganese, silicon, iron copper and aluminum are blended together in a preselected ration with a glass frit and screening agent. The preferred composition is a 76Ni/17Cr/4Si/3Mn proportion for the metal constituents, which provides a very low TCR and stable resistance. For the purposes of this disclosure, all ratios and percentages will be weight percentages.

The nickel and chromium powders are preferred to be of very small size, preferably below about five microns. The nickel may be made from a chemical precipitation of a nickel carbonyl. The remaining metal flux agents such as manganese and silicon should also preferably be less than five microns in size.

The metal flux constituents simultaneously assist in the formation of a low TCR alloy and chemical bonding with the substrate. The resulting resistor has greatly improved adhesion to the substrate over the pre-alloyed versions of the prior art. Manganese and silicon, both which form strong chemical bonds with an alumina substrate at the preferred firing temperatures, are most preferred.

Suitable glass frits are lead and bismuth free, and may be selected from, for example, the borosilicate family. The screening agent will preferably contain an acrylic resin in a volatilizable solvent to yield negligible carbonaceous residues in the fired film. The ingredients will typically be combined together and ball milled to ensure thorough mixing.

After mixing, the ingredients are then applied by screen printing in the usual manner and then fired in a nitrogen atmosphere. The peak firing temperature is preferred to be below 1,000° C., as a relatively low cost Nichrome kiln standard in the thick film industry is preferably used. In order to ensure alloying of the nickel and chromium at these low temperatures, the amount of high melting chromium is recommended to be below about twenty percent. A small amount of low melting point metals, such as aluminum, copper, manganese, silicon and iron may be added to help the alloy formation during sintering below 1,000° C. The glass frit, preferably in a range of from about 20 percent of the fired film to about 60 percent, may also help initiate alloy formation. Additionally, and as is known, the glass frit and flux may be used to adjust resistance and TCR of the fired resistor.

Firing temperature also has some affect on TCR and resistance and should be adjusted accordingly. Firing time at the peak temperature is more critical for the present invention than for other thick film resistors. In order to obtain a good TCR, a slow speed is preferred. For 910° C. or 930° C. firing, two inches per minute (ipm) may yield a better TCR than a belt speed of five ipm.

EXAMPLE 1

A thick film resistor composition was produced from a 76Ni/17Cr/4Si/3Mn mixture, with all metal constituents having an average particle size of less than five microns. Twenty percent by weight borosilicate glass frit was included, and screening agent was then added. Both the glass frit and screening agent were of composition suited for nitrogen atmosphere firing. The compositions were made on a three roll mill to adjust the rheology for easy screen printing.

EXAMPLE 2

Several resistors were formed by screen printing the composition from example 1 onto alumina substrates. The substrates were then fired in a nitrogen atmosphere using a nichrome kiln at peak temperatures of 900, 910, 920, 930 and 950 degrees Centigrade and a belt speed of two ipm. All resistors yielded hot and cold TCR's of less than 100 ppm/°C. The resistances varied from 1.2 ohms/square to 0.7 ohms/square, with the lower resistances obtained at higher peak firing temperatures.

EXAMPLE 3

The amount of glass frit was varied from example 1 to as high as 60 percent, with all other ingredients unchanged. The resulting resistances ranged from 0.4 ohms per square to 1.6 ohms per square, and all had TCRs within ±100 ppm/°C.

EXAMPLE 4

Resistors were made using the composition of example 1 on 96 percent alumina substrates. Copper conductors fired at 900° C. in nitrogen were used to terminate the resistors. Comparative samples were made according to manufacturers specifications from palladium silver cermet compositions. Lightning and current surge testing was conducted following the industry standard Bellcore TA NWT1089 specification.

For the same test conditions at increasing voltage levels, the best palladium silver resistors failed due to arcing at 700 and 800 volts, while the resistors of the preferred embodiment did not arc at 1,000 volts.

Additionally, the resistors of the present invention changed resistance under these severe conditions by only about two percent.

The present invention is most surprising in light of the alloying process which occurs. From the phase diagram, nickel and chromium can be alloyed between the temperatures of 1455° C. and 1880° C., which are the melting points of nickel and chromium, respectively. Using the teachings of the present invention, alloying between nickel and chromium occurs during firing using a nickel chromium heating element, at temperatures below 1,000° C.

These resistors are compatible with other base metal conductors, resistors and dielectrics. They also exhibit the outstanding environmental stability needed for thick film circuit applications. The fired resistors show very low sheet resistance and excellent TCR characteristics. Temperature coefficients of resistance within ±100 ppm/°C. can be obtained in the range of 80 Ni/20 Cr and 76 Ni/16 Cr. This is compared to a TCR of 4000 ppm/°C. for chromium and 6000 ppm/°C. for nickel.

The resulting resistors exhibit the superior heat resistance inherent in the Nichrome wire counterpart, while providing a substantially improved adhesive bond to the substrate over the pre-alloyed thick film Nichrome composition of the prior art.

While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

I claim:

1. A thick film resistor composition for firing upon a substrate, said resistor composition comprising:

a conductive constituent comprising 76 percent nickel powder, 17 percent chromium powder, 4 percent silicon powder and 3 percent manganese powder; and a non-conductive binder constituent.

* * * * *